US005831271A

United States Patent [19]

Okano et al.

[11] Patent Number: 5,831,271

[45] **Date of Patent: *Nov. 3, 1998**

[54] SHIELDING MEMBER FOR RADIOACTIVE SUBSTANCE, MANUFACTURING METHOD FOR THE SHIELDING MEMBER AND APPARATUS FOR PRODUCING RADIOACTIVE SOLUTION

[75] Inventors: Sakae Okano, Sodegaura; Fumiya Obata, Arakaw-Ku; Masato Ohya, Sanda; Yoshimasa Tanaka, Sodegaura, all of Japan

[73] Assignee: Nihon Medi-Physics Co., Ltd., Nishinomiya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 633,027

[22] Filed: Apr. 16, 1996

[30] Foreign Application Priority Data

Apr. 20, 1995 [JP] Japan ..... 7-119155
Mar. 19, 1996 [JP] Japan ..... 8-063171

[51] Int. Cl.[6] ..... G21F 5/00

[52] U.S. Cl. ..... 250/432 PD; 250/506.1; 250/507.1

[58] Field of Search ..... 250/432 PD, 507.1, 250/506.1

[56] References Cited

U.S. PATENT DOCUMENTS

| | | | |
|---|---|---|---|
| 3,535,085 | 10/1970 | Shumate | 23/252 |
| 3,912,935 | 10/1975 | Harris | 250/432 PD |
| 4,333,911 | 6/1982 | Comar et al. | 250/432 PD |
| 4,752,437 | 6/1988 | Ito et al. | 250/507.1 |
| 4,754,894 | 7/1988 | Simon et al. | 250/506.1 |
| 5,397,902 | 3/1995 | Castner et al. | 250/432 PD |

FOREIGN PATENT DOCUMENTS

| | | |
|---|---|---|
| 0096918A1 | 12/1983 | European Pat. Off. . |
| 0220937A2 | 5/1987 | European Pat. Off. . |
| 0314025A2 | 5/1989 | European Pat. Off. . |
| 0314025A3 | 5/1989 | European Pat. Off. . |
| 0555919A1 | 8/1993 | European Pat. Off. . |
| 0586368A1 | 3/1994 | European Pat. Off. . |
| 43-23120 | 10/1968 | Japan . |
| 55-6807 | 1/1980 | Japan . |
| 57-159199 | 10/1982 | Japan . |
| 61-153597 | 7/1986 | Japan . |

OTHER PUBLICATIONS

Patent Abstract of Japan, vol. 16, No. 225 (P–1360), 26 May 1992 & JP–A–4 047296 (Mitsubishi Heavy Ind Ltd), 17 Feb. 1992.

Database WPI, Week 8817, Derwent Publications Ltd., London, GB; AN 88–115722 & JP–A–63 061 999 (Toshiba) 18 Mar. 1988.

*Primary Examiner*—Jack I. Berman
*Attorney, Agent, or Firm*—Jones, Tullar & Cooper, P.C.

[57] ABSTRACT

The present invention provides a shielding member for radioactive substances which can be made compact in size and light in weight while maintaining its shielding ability, or improves the shielding ability while keeping the same size, thereby to store a large volume of radioactivity. At the same time, the present invention provides a manufacturing method for the above shielding member and a radioactive solution-producing apparatus using the above shielding member. The radioactive substance-shielding member uses two or more kinds of radiation shielding materials of different shielding abilities. A shielding body made of a shielding material of the highest shielding ability is arranged at an area which is the nearest to a radioactive source.

6 Claims, 10 Drawing Sheets

○ LEAD ONLY
▲ LEAD+ TUNGSTEN OF 10mm
□ LEAD+ TUNGSTEN OF 15mm
◆ LEAD+ TUNGSTEN OF 20mm

□ LEAD 40mm
(THIS CONSTITUTION CORRESPONDS TO THE 1ST CONTAINER.)

■ LEAD 30mm+ TUNGSTEN 10mm
(THIS CONSTITUTION CORRESPONDS TO THE 11THE CONTAINER.)

SHIELDING MEMBER FOR RADIOACTIVE SUBSTANCE, MANUFACTURING METHOD FOR THE SHIELDING MEMBER AND APPARATUS FOR PRODUCING RADIOACTIVE SOLUTION

BACKGROUND OF THE INVENTION

The present invention relates to a shielding member for radioactive substances, particularly for use in containers or the like to transport radioactive solutions for medical use. The present invention also relates to a method manufacturing the shielding member, and to an apparatus for producing radioactive solutions equipped with the shielding member.

While there are containers of various shapes and various materials that are equipped with shielding members for radioactive substances, shielding members of transportation containers used to transport or preserve vials, ampoules, so-called prefilled syringes filled with medical radioactive solutions and the like or shielding members used in radioactive solution-producing apparatuses named as generators are generally known to be formed of lead alone.

Under the present situation, the shielding ability of these kinds of shielding members is secured by thickening a shielding body if the level of radioactivity of a to-be-stored radioactive substance is increased. Or, the shielding members are sometimes stored in larger shielding members to transport the container in order to ensure the shielding ability.

When the shielding body is made thick, the shielding member itself becomes bulky in size and heavy in weight, which causes an inconvenience to handle the container equipped with the shielding member. Moreover, when the general shielding member is accommodated in a much larger shielding member, both the weight and the volume are greatly increased, with the other accompanying disadvantages.

Although the shielding member may be light in weight and compact when tungsten, which has a higher shielding ability against radioactivity than lead is used as a material for the shielding body as compared with when lead is used, tungsten is expensive and therefore uneconomic if the whole of the shielding body is made of tungsten. So, tungsten cannot be employed for a large shielding member.

It is also complicated and uneconomic to manufacture shielding members of different shielding ability in accordance with the kinds and radioactive intensities of to-be-stored radioactive substances.

SUMMARY OF THE INVENTION

An object of the present invention is therefore to provide a shielding member for radioactive substances which can be small in size and light in weight while holding the same shielding ability as the conventional art, or which can enhance the shielding ability when it is of the same size as the conventional art, and can thereby store radioactive substances of higher radioactive intensities and change shielding ability in accordance with the change in kinds and intensities of to-be-stored radioactive substances, while eliminating the aforementioned disadvantages inherent in the conventional art. The present invention aims also to provide a manufacturing method for the above shielding member for radioactive substances and an apparatus for producing radioactive solution using the above radioactive substance-shielding member.

Two or more kinds of radiation shielding materials of different shielding abilities enables a container to be light-weight while maintaining a leak dose from the container at the same level as a conventional standard.

In accomplishing these and other objects, according to one aspect of the present invention, there is provided a shielding member for radioactive substances comprising a container part having a recessed part for accommodating radioactive substances, and a lid part covering an opening of the recessed part and fitted to the container part, wherein the container part includes a first shielding body and a second shielding body of a higher radiation shielding ability than the first shielding body, at least part of an area forming the recessed part is constituted of the second shielding body, the lid part is constituted of a shielding body of at least one kind of radiation shielding material.

According to a second aspect of the present invention, there is provided an apparatus for generating a radioactive solution which is equipped with a radioactive substance shielding member comprising a container part having a recessed part for accommodating radioactive substances and a lid part covering an opening of the recessed part and fitted to the container part, wherein a bottom shielding body at a bottom part of the recessed part, a side shielding body defining a side part of the recessed part at a position orthogonal to an axial direction of the recessed part and extending a total length or a length not fully the total length of the recessed part in the axial direction in the container part, and a shielding body disposed at a part facing the opening of the recessed part in the lid part are formed of tungsten, with other parts of the radioactive substance shielding member being formed of lead, furthermore, wherein the recessed part accommodates a column storing a parent radioactive nuclide and is provided with an eluant feed means connected to the column for feeding an eluant to the column and a radioactive solution discharge means connected to the column for discharging a radioactive solution including a daughter radioactive nuclide eluted from the column.

According to a third aspect of the present invention, there is provided a method for manufacturing a radioactive substance shielding member comprising a container part having a recessed part for accommodating radioactive substances and a lid part covering an opening of the recessed part and fitted to the container part, wherein the container part is manufactured in a process that a mold forming an outer shape of the container part is prepared, a side part of a projecting part to form the recessed part is covered with a side shielding body extending a length not fully the total length of the projecting part in an axial direction of the projecting part, a front end of the projecting part is covered with a bottom shielding body, a side face of the projecting part between the side shielding body and the bottom shielding body is covered with a coupling member along the axial direction of the projecting part, and then a radiation shielding material having a melting temperature not melting the side shielding body, the bottom shielding body and the coupling member is injected into the mold.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
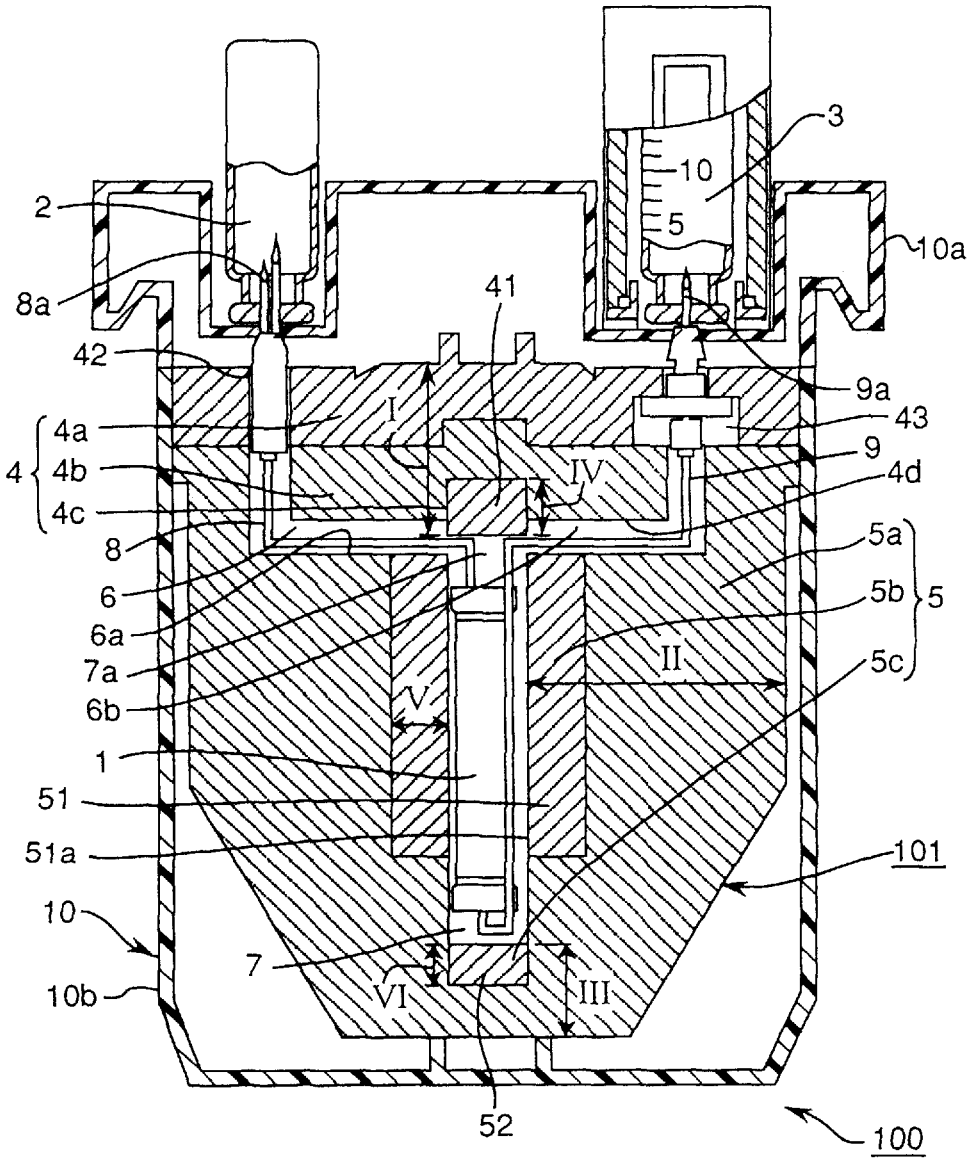
FIG. 1 is a sectional view showing the structure of an apparatus for producing a radioactive solution which uses a radioactive substance-shielding member according to one embodiment of the present invention, with the radioactive substance-shielding member being represented in a sectional view taken along a line XV—XV in FIG. 3.

Before the description of the present invention proceeds, it is to be noted that like parts are designated by like reference numerals throughout the accompanying drawings.

A shielding member for radioactive substances, a manufacturing method for the shielding member and a radioactive solution-producing apparatus using the shielding member according to preferred embodiments of the present invention will be described below with reference to the drawings.

A radioactive substance-shielding member of the present invention has a lid part and a container part of shielding bodies formed of radiation shielding materials. The lid part is formed of one or a plurality of radiation shielding materials, while the container part is formed of a plurality of radiation shielding materials.

At least either the lid part or the container part of the above shielding member comprises a plurality of shielding bodies of two or more kinds of radiation shielding materials of different shielding abilities.

Further, the radioactive substance-shielding member is characterized in that the shielding body formed of a radiation shielding material of a higher shielding ability is arranged at an inner side of a container, and the shielding body of a radiation shielding material of a lower shielding ability than that of the above shielding material is disposed outside the above shielding body.

A radioactive substance-shielding member using at least two or more kinds of shielding materials of different shielding abilities selected from lead, tungsten and depleted uranium is a suitable example of the above radioactive substance-shielding member. Particularly, a combination of tungsten and lead or a combination of depleted uranium and lead is ideal.

In the radioactive substance-shielding member according to an embodiment of the present invention, one or all of the inner shielding bodies constituting at least either one of the lid part and the container part is an independent molded body and may be designed to be exchangeable. Alternatively, a part or the whole of a plurality of shielding bodies constituting either one of the lid part and the container part may be integrally molded in one body.

A radioactive solution transportation container having a storing part for storing a radioactive solution vessel, and a radioactive solution-producing apparatus in which a radioactive substance-shielding member is provided with a column containing at least a parent radioactive nuclide, an eluant feed means and a radioactive solution discharge means are preferred embodiments of the present invention.

A further feature of the present invention relates to a manufacturing method for the container part of the radioactive substance-shielding member, whereby a mold corresponding to the container part of the radioactive substance-shielding member is prepared, a projecting part of the mold corresponding to a space for storing radioactive substances is coated with a preliminarily formed shielding body of a radiation shielding material having a sufficiently higher melting temperature than a radiation shielding material to be injected later into the mold, and then the radiation shielding material of a lower melting temperature than the above radiation shielding material is injected into the mold, thereby casting the container part in one body.

The radioactive substance-shielding member of this embodiment may be applicable to radioactive substances of approximately several mCi-several tens mCi radioactivity. However, manufacturing is complicated and cost is poor, consequently it is not advantageous in terms of the size and weight to combine shielding bodies of a plurality of radiation shielding materials in order to constitute the shielding member for radioactive substances having low radioactivity. Therefore, it is furthermore effective to apply the shielding member of the embodiment to storage of radioactive substances of, e.g., several hundreds mCi or higher radioactivity.

A shielding member for a radioactive solution-producing apparatus for medical use (technetium-99m generator) 100 as shown in FIG. 1 is one preferred embodiment. Molybdenum-99 that elutes a radioactive solution of 100–300 mCi (3.7–11.1 GBq) technetium-99m at a calibration time is stored in the generator 100.

Radiation shielding materials used for the above shielding member are, e.g., lead, tungsten, depleted uranium, boron steel, boron stainless steel, cadmium, stainless steel, concrete, plastics, etc. One or more of the shielding materials is properly selected in accordance with the kind(s) and amount of radioactivity of the radioactive substance to be stored in the shielding member. On the other hand, it is better to combine and use two or more kinds of γ-ray shielding materials, for example, chosen from lead, tungsten and depleted uranium for the medical radioactive solution transportation container or the radioactive solution-producing apparatus. A combination of lead and tungsten or a combination of lead and depleted uranium is favorable because of its good shielding ability. Especially, tungsten and lead are preferred as the shielding material of the shielding member for the medical radioactive solution-producing apparatus or medical radioactive solution transportation container from the viewpoint of manufacturing convenience, ease of handling and cost.

In comparison with 11.3 g/cm$^3$ density of lead, densities of tungsten and depleted uranium are large, specifically, 19.3 g/cm$^3$ and 19.0 g/cm$^3$. Therefore, it is desirable to arrange tungsten or depleted uranium having high shielding ability at the inner side of the shielding member so as to make the shielding member light-weight.

Figure 9:
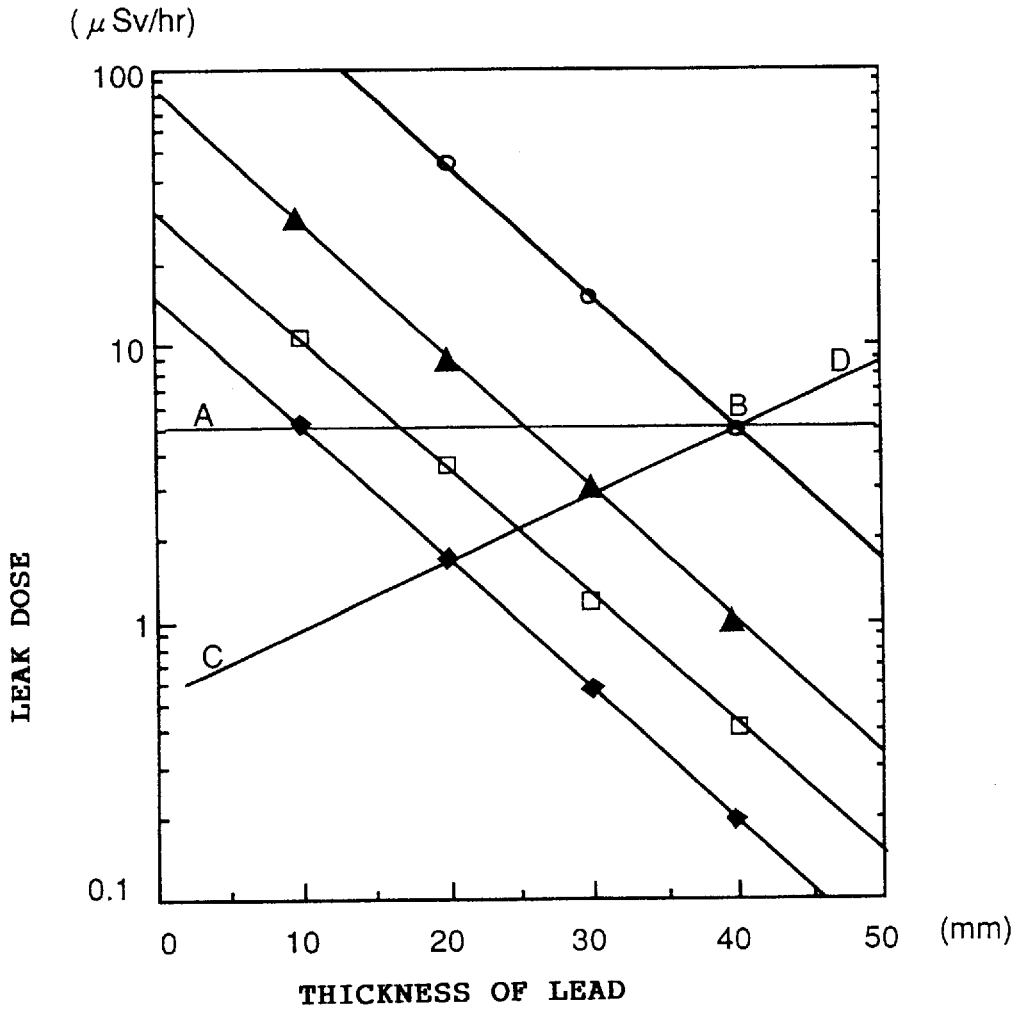
FIG. 9 is a graph of a relation of a thickness of tungsten and lead and a leak dose.

A relation between a thickness of tungsten and lead and a leak dose is indicated in FIG. 9.

As is clearly understood from line A–B in FIG. 9, if the leak dose is constant, lead may be thinned by increasing the thickness of tungsten.

Also as is apparent from a line C–D, when the total thickness of the shielding body formed of a combination of tungsten and lead is constant, the leak dose can be reduced by increasing the thickness of tungsten.

In FIG. 9, each symbol has the following meaning.

The symbol "○" shows the leak dose in the case where the container is made of lead only. The symbols "▼", "□" and "◆" show the leak doses in the case where the container is formed of a shielding body of lead and shielding body of tungsten disposed closely to the shielding body of lead. The symbol "▼" shows the case whereby the tungsten has a thickness of 10 mm, "□" has a thickness of 15 mm, and "◆" has a thickness of 20 mm, respectively.

In the case where charged particles are emitted from a radioactive source, it is effective to shield the radioactive source by means of a low-density substance to restrict the generation of braking X-rays. At the same time, since some shielding materials like lead are soft and weak to shocks or exert metallic toxicity, and for the sake of handling and transportation convenience, it is desired to coat the surface or exposed surface of the shielding material with plastic or the like if the shielding material is depleted uranium, lead, etc.

As will be described in detail later, it is favorable to form inner shielding bodies and other shielding bodies of the shielding member independently and use the bodies in combination to allow one or all of the inner shielding bodies to be easily exchanged, detached or fitted. In this case, the thickness of the shielding body forming the storing part in the shielding member is changed or the kind of radiation shielding material is selected in accordance with the kind(s) and amount of radioactivity of the radioactive substance stored in the storing part, whereby the leak dose from the shielding member is regulated and the shielding member is made light in weight without changing the outer dimensions of the shielding member. Even if the kind(s) or amount of radioactivity of the radioactive substance stored in the shielding member is changed, one type of shielding member meets the case, i.e., the shielding member is advantageously versatile for general purpose and therefore economic.

Figure 2:
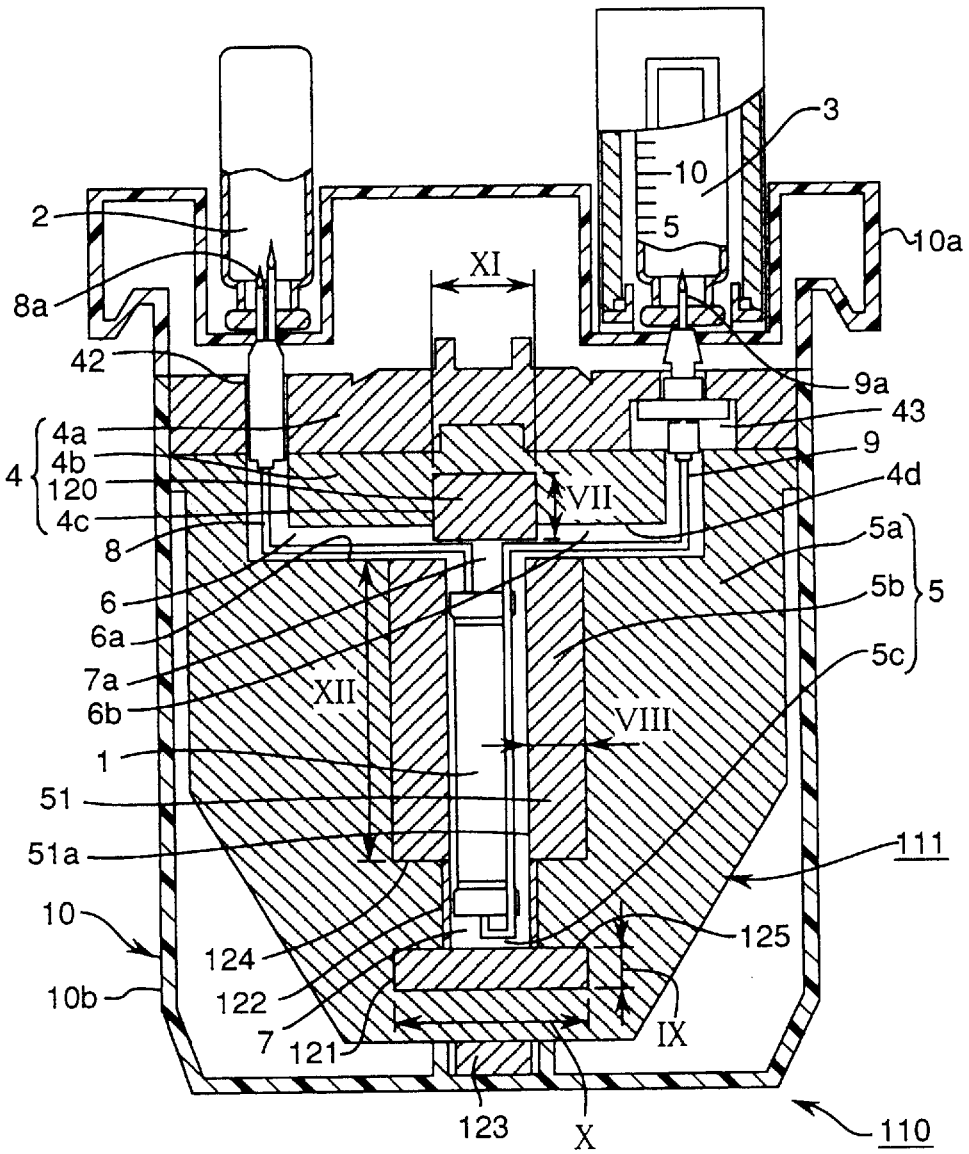
FIG. 2 is a sectional view showing the structure of the radioactive solution-producing apparatus of FIG. 1 according to a different embodiment.
Figure 3:
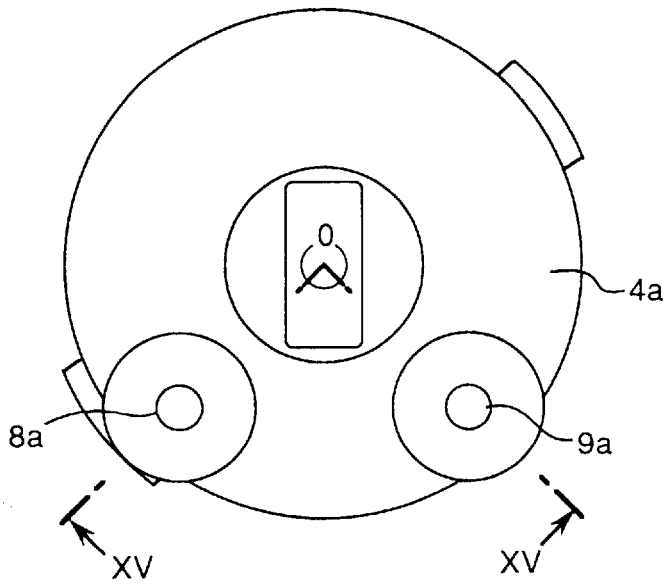
FIG. 3 is a plan view of the radioactive substance-shielding member in the radioactive solution-producing apparatus of FIGS. 1 and 2.
Figure 4:
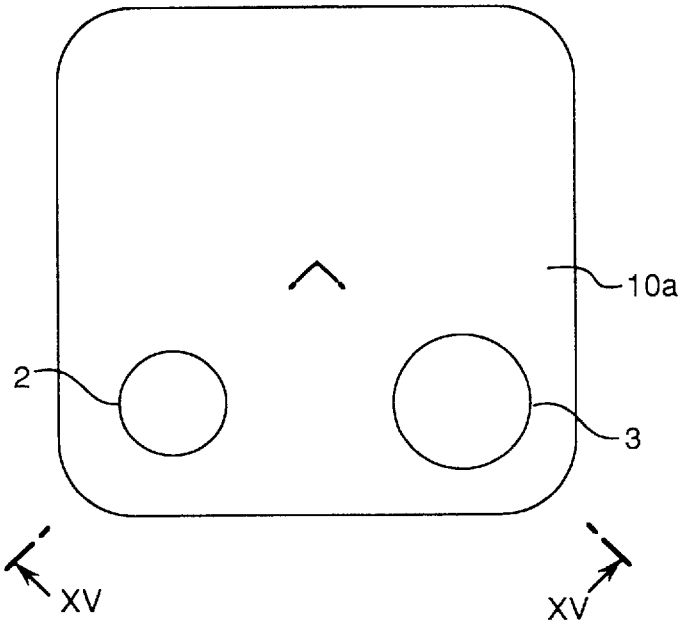
FIG. 4 is a plan view of the radioactive solution-producing apparatus shown in FIGS. 1 and 2.

A concrete example of the shielding member for radioactive substance of an embodiment according to the present invention will be depicted hereinbelow with reference to the drawings when used in a technetium-99m generator that corresponds to the radioactive solution-producing apparatus. FIG. 3 is a plan view of a radioactive substance-shielding member 101 shown in FIGS. 1 and 2. The radioactive substance-shielding member 101 in FIGS. 1 and 2 is shown as a sectional view taken along a line XV—XV of FIG. 3.

In the radioactive solution-producing apparatus (technetium-99m generator) 100 in FIG. 1, the radioactive substance-shielding member 101 comprising a lid part 4 and a container part 5 of shielding bodies of radiation shielding materials is provided with an alumina column 1 having molybdenum-99 as a parent radioactive nuclide adsorbed thereto, an eluant feed means 8 having an eluant feed port 8*a* to which a vial 2 filled with isotonic soduim chloride solution is fitted, a radioactive solution discharge means 9 having an eluate discharge port 9*a,* etc. A vacuum vial 3 to collect technetium-99m solution as a daughter radioactive nuclide eluted from molybdenum-99 is set to the discharge means 9.

The container part 5 is generally a circular cylinder, having a first recessed part 6 and a second recessed part 7 at a central part thereof. The first recessed part 6 has a small depth in an axial direction of the container part 5. The second recessed part 7 formed at a bottom part 6*a* of the first recessed part 6 for accommodating the alumina column 1 therein is smaller in diameter than the first recessed part 6 and has a large depth in the axial direction of the container part 5. A peripheral part 5*b* of the second recessed part 7 is formed of a cylindrical tungsten shielding body 51 of a predetermined thickness and a predetermined length from a bottom surface of the bottom part 6*a* in an axial direction of the second recessed part 7. The tungsten shielding body 51 corresponds to one embodiment of the second shielding body and the side shielding body. The tungsten shielding body 51 may be formed for the entire length in the axial direction of the second recessed part 7. In the instant embodiment, however, since the alumina column 1 is used, having molybdenum-99 adsorbed only to a part of a relatively upper part thereof, the shielding body 51 is extended approximately 60–70% of the total length of the second recessed part 7 from the bottom surface of the bottom part 6*a* as the shielding ability and weight are taken into consideration, as shown in the drawing. A bottom part 5*c* of the second recessed part 7 of a predetermined thickness in the axial direction is provided with a tungsten shielding body 52 that is an embodiment of the bottom shielding body. The tungsten shielding body 52 also corresponds to one embodiment of the second shielding body. A remaining part 5*a* of the container part 5 excluding the peripheral part 5*b* and the bottom part 5*c* is formed of lead. The container part 5 is constituted of the lead part 5*a,* peripheral part 5*b* of tungsten and bottom part 5*c* of tungsten. The lead part 5*a* is an example of the first shielding body.

The alumina column 1 is properly supported and accommodated in the second recessed part 7, for example, by a projecting part (not shown) formed at an inner peripheral surface 51*a* of the tungsten shielding body 51. To the alumina column 1 are connected as indicated in the drawing the eluant feed means 8 for feeding isotonic soduim chloride solution from the vial 2 to the alumina column 1 and the radioactive solution discharge means 9 for guiding technetium-99m solution eluted by the supplied eluate to the vacuum vial 3.

The lid part 4 consists of an outer shielding body 4*a* made of lead, an inner shielding body 4*b* made of lead and a shielding body 41 made of tungsten. The inner shielding body 4*b* is seated in the first recessed part 6. The above outer shielding body 4*a* and inner shielding body 4*b* are embodiments of the third shielding body, while the tungsten shielding body 41 corresponds to an embodiment of the fourth shielding body. A space 6*b* is defined in the inner shielding body 4*b* to allow for passage of the feed means 8 and the discharge means 9. A recessed part 4*c* of a circular cylinder is formed at a bottom surface 4*d* of the inner shielding body 4*b* facing an opening 7*a* of the second recessed part 7, into which the tungsten shielding body 41 is fitted. Other parts than the recessed part 4*c* of the inner shielding body 4*b* are formed of lead.

The outer shielding body 4*a* is generally in the shape of a disc covering an upper surface of the container part 5 with the inner shielding body 4*b* fitted in the first recessed part 6.

Spaces 42 and 43 are provided to extend the feed means 8 and the discharge means 9 in the outer shielding body 4*a*.

The lid part 4 and the container part 5 are accommodated in a plastic exterior container 10 of a generally box-like shape. An upper part 10*a* of the exterior container 10 to which the isotonic soduim chloride solution vial 2 and the vacuum vial 3 are attachable is detachably coupled by an engaging means (not shown) with a lower part lob housing the lid part 4 and the container part 5.

According to the embodiment, the lid part 4 is formed schematically like a disc, similarly, the container part 5 is generally cylindrical, the tungsten shielding body 41 of the recessed part 4*c* is disc-shaped, the first recessed part 6 and second recessed part 7 are circular in their outer form, the tungsten shielding body 51 is cylindrical and the tungsten shielding body 52 is disc-shaped. However, each of these parts is not restricted in shape to the above embodiment. For instance, the lid part 4 and the container part 5 may be polygonal, the tungsten shielding body 51 may be a prism, or the tungsten shielding body 51 may be integrally molded with the tungsten shielding body 52 into the shape of a cup, or the recessed part 4*c* and the bottom part 5*c* may be in other shapes than a disc.

In using the radioactive solution-producing apparatus 100, in the first place, the isotonic soduim chloride solution vial 2 is set at the eluant feed port 8*a* of the feed means 8, and the vacuum vial 3 is fitted at the eluate discharge port 9*a* of the radioactive solution discharge means 9. In the arrangement as noted above, the isotonic soduim chloride solution in the vial 2 passes through the feed means 8 to the alumina column 1 because of the vacuum pressure of the vacuum vial 3. As a result, the solution including the daughter radioactive nuclide, i.e., technetium-99m eluted from the alumina column 1 is collected in the vacuum vial 3 through the discharge means 9.

Now, a relation between the thickness of the shielding body of a combination of two kinds of radiation shielding materials and a weight of the shielding body will be discussed with respect to the above shielding member of the structure in the radioactive solution-producing apparatus 100 (technetium-99m generator). More specifically, while molybdenum-99 of 200 mCi radioactivity is kept in the alumina column 1, a leak dose in a first measuring container having a lid part and a container part corresponding to the lid part 4 and the container part 5 formed only of lead is measured. Then, a relation of a thickness and a weight of each shielding member formed of a combination of a lead shielding body and a tungsten shielding body to secure the equivalent shielding ability as the above first container for measuring is checked. The result is indicated in Table 1 in which "an upper surface", "a side surface" and "a bottom surface" of the lead shielding body correspond to [I], [II] and [III] in FIG. 1, and "an upper surface", "a side surface" and "a bottom surface" of the tungsten shielding body correspond to [IV], [V] and [VI] in FIG. 1, respectively.

TABLE 1

| Container for measuring | | 1st | 2nd | 3rd | 4th | 5th |
|---|---|---|---|---|---|---|
| Thickness of lead; | Upper surface (mm) | 45 | 30 | 22 | 15 | 0 |
| | Side surface (mm) | 40 | 25 | 17 | 10 | 0 |
| | Bottom surface (mm) | 17 | 2 | 0 | 0 | 0 |

TABLE 1-continued

| Container for measuring | | 1st | 2nd | 3rd | 4th | 5th |
|---|---|---|---|---|---|---|
| Thickness of tungsten; | Upper surface (mm) | 0 | 10 | 15 | 20 | 30 |
| | Side surface (mm) | 0 | 10 | 15 | 20 | 27 |
| | Bottom surface (mm) | 0 | 10 | 12 | 12 | 12 |
| Total weight (g) | | 9798 | 7518 | 7216 | 7627 | 7812 |
| Weight ratio | | 1 | 0.77 | 0.74 | 0.78 | 0.80 |

(The weight ratio is calculated based on the weight of the 1st container for measuring as a reference.)

As is made clear from Table 1, in the 5th measuring container using 30 mm-thick tungsten as compared with the 1st measuring container having both the lid part and the container part totally formed of lead, the outer shape is made smaller and the weight is reduced. It is expensive if the whole of the lid part and the container part is formed of tungsten.

On the other hand, when lead and tungsten shielding bodies are used in combination as in the 2nd–4th measuring containers, the weight is further reduced over that in the 5th measuring container consisting of the lid part and the container part totally formed of tungsten. That is, while the 1st measuring container is about 10 kg, each of the 2nd–4th measuring containers is reduced to about 7.2–7.6 kg. Therefore, the radioactive solution-producing apparatus using the above type of radioactive substance-shielding member is more convenient to carry, as compared with the conventional one.

The above facts confirm that it is effective to combine two kinds of radiation shielding materials to secure the shielding ability and lighten the shielding member.

Figure 10:
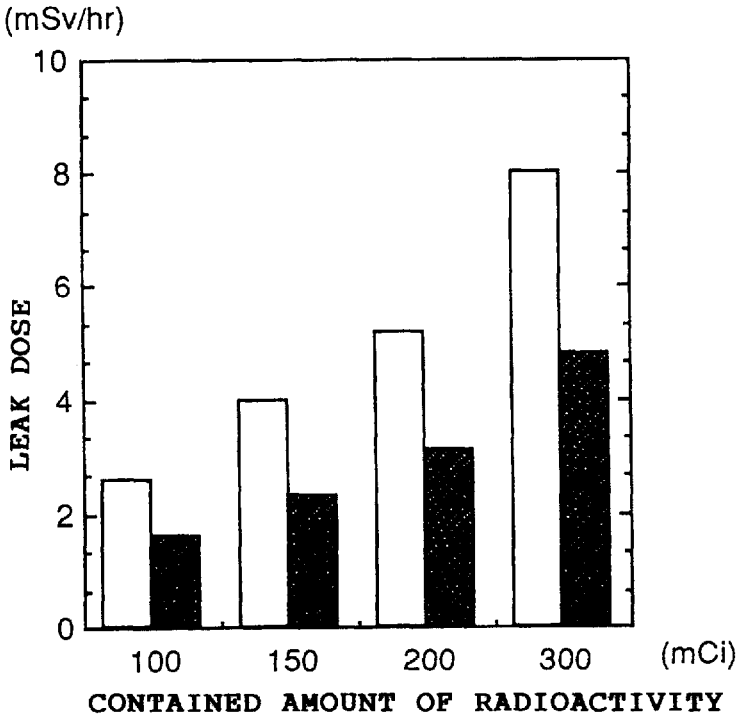
FIG. 10 is a graph of the relationship between stored radioactivity and a leak dose.

Meanwhile, an 11th measuring container is prepared by decreasing the lead thickness of the 1st measuring container from 40 mm to 30 mm and providing the peripheral part 5*b* of FIG. 1 with 10 mm-thick tungsten to thereby set the above [II] to be 40 mm. A relation of an amount of radioactivity and a leak dose is detected for each of the 11th and 1st measuring containers. The leak dose of the 11th measuring container is, as shown in FIG. 10, approximately 60% of the technetium-99m generator formed solely of lead which corresponds to the 1st measuring container. If the leak dose of the 11th measuring container is kept equivalent to that of the 1st measuring container, the 11th measuring container can store radioactive substances of nearly 1.5 times an amount of radioactivity of the 1st container.

Subsequently, when the radioactivity in the alumina column 1 is increased 1.5 times from 200 mCi (7.4 GBq) to 300 mCi (11.1 GBq), a thickness, a weight and a weight ratio of each shielding body of the 6th–10th measuring containers to secure the equivalent shielding ability to that of the 1st container are shown in Table 2.

Since it is necessary to increase the thickness of shielding bodies of the 6th measuring container wherein all of the shielding bodies are formed of lead so as to ensure the shielding ability, the weight of the 6th measuring container becomes nearly 1.2 times, i.e., approximately 12 kg that of the 1st measuring container.

In the meantime, when a shielding body of 10 mm-thick tungsten is combined with a lead shielding body as in the 7th measuring container, the thickness of each shielding body and the leak dose (shielding ability) are similar to those of the 1st measuring container. Moreover, the weight becomes about 80% that of the 6th measuring container in which the whole shielding bodies are formed of lead. Accordingly, the 7th measuring container achieves shielding against higher radioactivity by the shielding member of the same shielding ability and the same weight as the conventional art.

TABLE 2

| Container for measuring | | 6th | 7th | 8th | 9th | 10th |
|---|---|---|---|---|---|---|
| Thickness of lead; | Upper surface (mm) | 49 | 34 | 26 | 19 | 0 |
| | Side surface (mm) | 44 | 29 | 21 | 14 | 0 |
| | Bottom surface (mm) | 21 | 6 | 0 | 0 | 0 |
| Thickness of tungsten; | Upper surface (mm) | 0 | 10 | 15 | 20 | 33 |
| | Side surface (mm) | 0 | 10 | 15 | 20 | 30 |
| | Bottom surface (mm) | 0 | 10 | 14 | 14 | 14 |
| Total weight (g) | | 12122 | 9502 | 8575 | 9193 | 9435 |
| Weight ratio | | 1.24 | 0.97 | 0.88 | 0.93 | 0.96 |

(The weight ratio is calculated based on the weight of the 1st measuring container as a reference.)

From the foregoing results, it is confirmed that combining two kinds of radiation shielding bodies made of tungsten and lead is effective to improve the shielding ability and to increase an amount of radioactivity to be stored while securing a constant shielding ability.

In the radioactive solution-producing apparatus 100 shown in FIG. 1, as described before, since the peripheral part 5*b* of the second recessed part 7 is a simple cylinder having the smaller diameter than that of the inner shielding body 4*b* as illustrated in the drawing, the tungsten shielding body 51 at the peripheral part 5*b* of the container part 5 can be pulled out in the axial direction of the second recessed part 7 and exchanged with other members of tungsten or other materials of a smaller thickness than the tungsten shielding body 51.

At the same time, since the tungsten shielding body 41 fitted in the recessed part 4*c* of the inner shielding body 4*b* is like a disc and slightly projects from the bottom surface 4*d*, the shielding body 41 is exchangeable with a thinner shielding body and accordingly rendered lighter in weight without changing an outer diameter of the inner shielding body 4*b*.

Because of the exchangeability of the shielding bodies 51 and 41 at the peripheral part 5*b* and recessed part 4*c* as described hereinabove, when the radioactive substance to be stored in the recessed part 7 is low in radioactive intensity, the shielding body at the peripheral part 5*b* may be formed of, e.g., lead. In contrast, if the radioactive intensity of the stored substance is high, the lead shielding body can be thickened or replaced with a tungsten shielding body. If the radioactivity is still much higher, the shielding body of tungsten may be increased in thickness. In other words, even when the radioactivity of the radioactive substance stored in the second recessed part 7 is changed, one kind of shielding body at the lead part 5*a* of the container part 5 and one kind of exterior container 10, etc. are sufficient, which makes the producing apparatus economical and convenient in practical use. Furthermore, the shielding body at the bottom part 5*c* may be made exchangeable, the second recessed part 7 may be formed of one cup-like shielding body, or the thickness or the kind of the radiation shielding material of the cup-like shielding body may be changed.

For instance, if the shielding body at the peripheral part 5*b* is allowed to be thin, a light weight member such as plastic or the like is inserted between the shielding body at the peripheral part 5*b* and the lead part 5*a* to thereby reduce weight.

If it is not necessary to change the shielding bodies as above, shielding bodies formed separately from each other may be fixed by bonding or the like manner into one body.

Depleted uranium may be used in place of tungsten as the shielding material.

Although detailed later, when the shielding member is manufactured by an integral casting method whereby the shielding body at the peripheral part 5*b* is formed of tungsten, etc. beforehand and, lead or the like radiation shielding material is injected into the part 5*a* outside the peripheral part 5*b*, this method restricts manufacturing costs and facilitates the manufacture. Moreover, the method is suitable to cast and form the inner shielding body because tungsten not only shows a higher shielding ability, but has a sufficiently higher melting point than lead. Tungsten melts at approximately 1800° C. while the melting point of lead is about 300° C.

The foregoing description relating to the exchange and manufacturing method of shielding bodies is similarly applicable to a radioactive substance-shielding member storing a radioactive solution container to be described later.

A radioactive solution-producing apparatus 110 as shown in FIG. 2 is devisable as another embodiment of the radioactive solution-producing apparatus 100. A difference in the apparatus 110 from the apparatus 100 is that the size of the shielding bodies at the recessed part 4*c* and the bottom part 5*c* is changed, a coupling member 122 is installed in the axial direction of the second recessed part 7 so as to form the second recessed part 7, and a shielding body 123 is added at the bottom part of the container part 5. The same structural parts are designated by the same reference numerals in FIGS. 1 and 2.

A shielding body 120 corresponding to the shielding body at the recessed part 4*c* is designed to have a little larger outer diameter XI than an inner diameter of the second recessed part 7 and a larger thickness or depth VII in the axial direction of the second recessed part 7. A shielding body 121 corresponding to the shielding body 52 at the bottom part 5*c* has a larger outer diameter X than the inner diameter of the second recessed part 7. In the present embodiment, the thickness VII of the shielding body 120 exceeds a thickness VIII of the shielding body 51 at the peripheral part 5*b*. Further, the outer diameter X of the shielding body 121 is almost the same as the outer diameter of the shielding body 51 at the peripheral part 5*b*, and a thickness or depth IX of the shielding body 121 is approximately equal to the above thickness VIII. The outer diameter X of the shielding body 121 is made larger than the inner diameter of the shielding body 51 so as to easily manufacture the shielding member according to a manufacturing method to be described later.

Concretely, the outer diameter XI of the shielding body 120 is 18 mm, the thickness VII is 16 mm, whereas the thickness VIII of the shielding body 51 is 10 mm and a length XII is 50 mm. The outer diameter X of the shielding body 121 is 35 mm and the thickness IX is 11 mm.

The coupling member 122 is a stainless steel pipe having the same inner diameter as the second recessed part 7 and connects a bottom surface 124 of the shielding body at the peripheral part 5*b* with an upper surface 125 of the shielding body 121. The coupling member 122 is arranged on the same axis as the second recessed part 7. Accordingly, the second recessed part 7 is made up of the shielding body 51 at the peripheral part 5*b*, the coupling member 122 and the shielding body 121.

Now, a manufacturing method for the shielding member will be discussed using as an example the above producing apparatuses 100 and 110.

Figure 5:
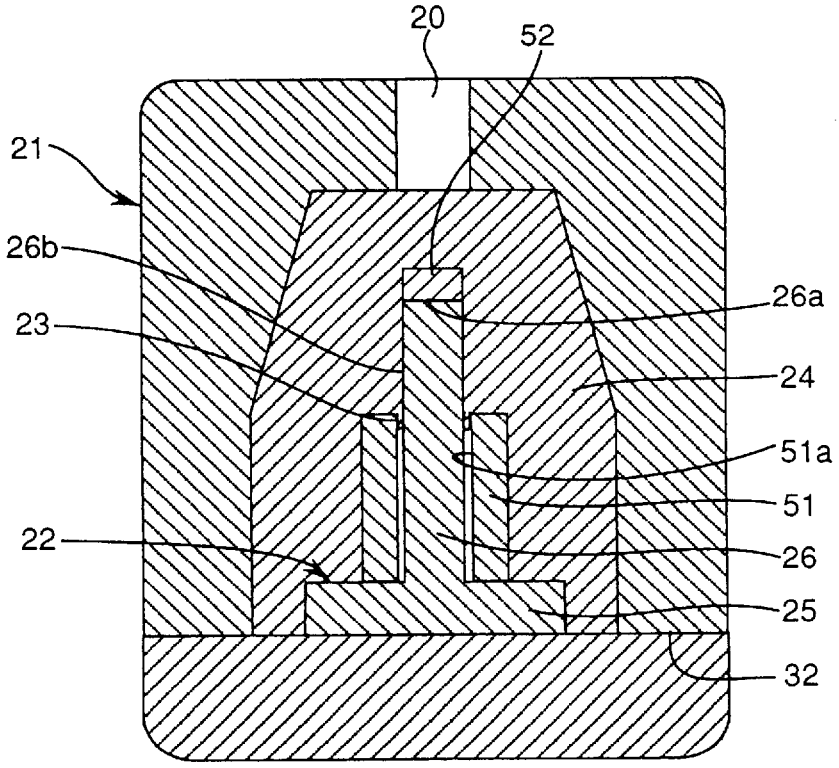
FIG. 5 is a sectional view of a mold used in a manufacturing method for a container part of the radioactive solution-producing apparatus of FIG. 1.

As indicated in FIG. 5, in a mold 21 used for forming the container part 5 of the shielding member of the producing apparatus 100, a core pin 22 of an inverted-T cross section is set within a recessed part 24 defined to form the lead part 5*a*. The core pin 22 is composed of a disc-like part 25 to form the first recessed part 6 and a columnar part 26 to form the second recessed part 7. The columnar part 26 is erected at the disc-like part 25 and integrally molded with the disc-like part 25. The tungsten shielding body 51 corresponding to the peripheral part 5*b* is fitted in the columnar part 26 and at the same time, the tungsten shielding body 52 corresponding to the bottom part 5*c* is mounted at a front end part 26*a* of the columnar part 26.

Lead is injected through a sprue 20 into the mold 21. As referred to earlier, the melting point of tungsten is sufficiently higher than that of lead, and therefore, tungsten is never melted when lead is injected. In the case where the tungsten shielding body is provided not over the entire length in the axial direction of the second recessed part 7, but a required shorter length than the total length of the second recessed part 7 from the viewpoint of the shielding ability, injected lead may sometimes enter a small gap 23 between a peripheral surface 26*b* of the columnar part 26 and an inner peripheral surface 51*a* of the shielding body 51, whereby a resultant molded article is hindered from separating from the columnar part 26.

Figure 6:
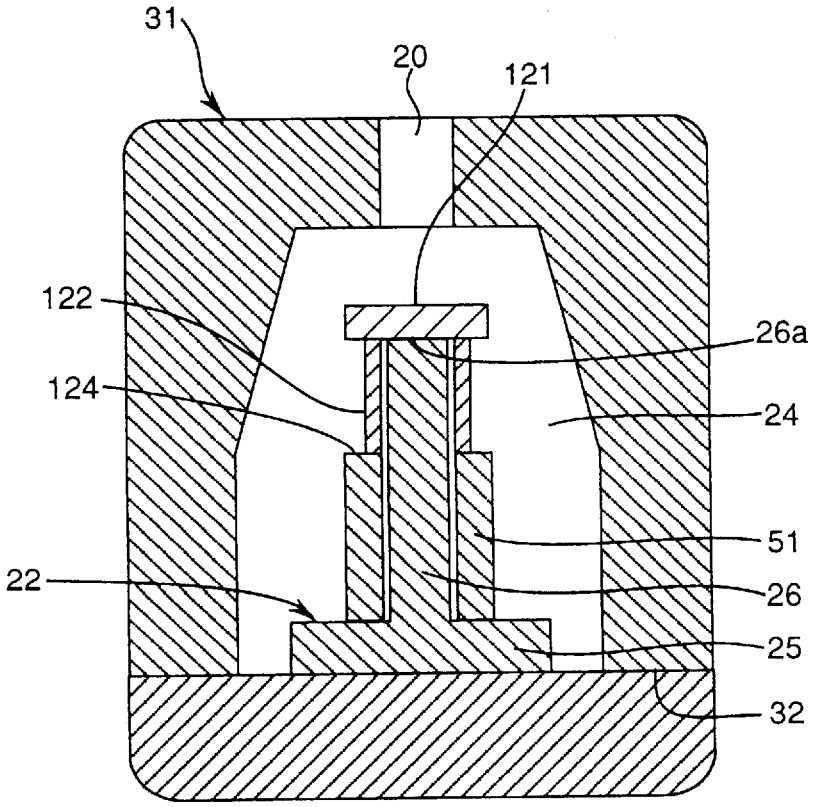
FIG. 6 is a sectional view of a mold used in a manufacturing method for a container part of the radioactive solution-producing apparatus of FIG. 2.

Although tungsten may be coated over the entire length of the columnar part 26 in order not to form the above gap 23, it is more economical to decrease the amount of expensive tungsten used as much as possible. As such, stainless steel which is inexpensive in comparison with tungsten and has a sufficiently higher melting temperature (about 1300° C.) than lead, or the like material may be used for parts not requiring tungsten to thereby cover the columnar part 26 completely. A radioactive solution-producing apparatus manufactured according to the manufacturing method which prevents the generation of the above gap 23 corresponds to a shielding member 111 of the producing apparatus 110. The radioactive solution-producing apparatus 110 is provided with the coupling member 122 of the stainless pipe, as mentioned earlier, between the bottom surface 124 of the shielding body 51 and the shielding body 121 at the front end part 26*a* of the columnar part 26. As shown in FIG. 6, the stainless steel coupling member 122 is provided at the columnar part 26 between the shielding body (51) and the shielding body 121 in a mold 31 for forming the container part 5 of the shielding member 111 of the producing apparatus 110. In the embodiment as noted above, the generation of the gap 23 is avoided. The molded article is consequently easily detached from the columnar part 26.

After the container part 5 of the producing apparatus 110 is formed by injecting lead from the sprue 20 of the mold 31, the mold is opened up and down at a separating part 32 and the container part 5 is taken out from the mold. Also, the lid part 4 is manufactured. The container part 5 obtained in the above manner is accommodated in the exterior container 10 as shown in FIG. 2, whereby the radioactive solution-producing apparatus 110 is completed by providing the column 1 containing the parent radioactive nuclide, lid part 4, eluant feed means 8, radioactive solution discharge means 9, etc.

Next, a radioactive solution transportation container using the above-described radioactive substance-shielding member will be described below.

Figure 7:
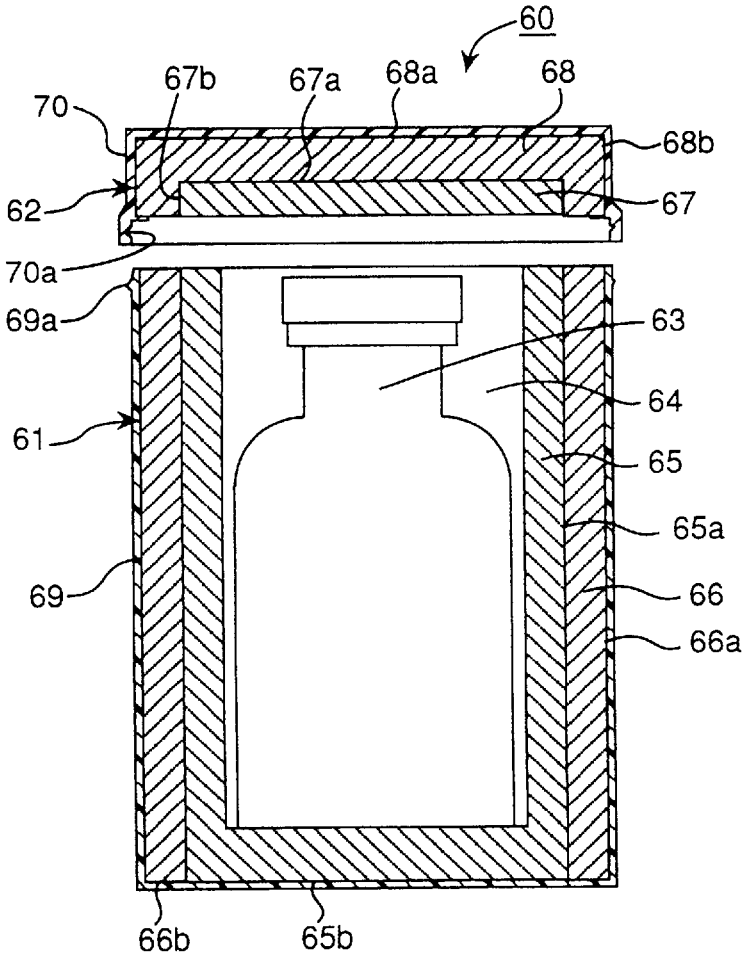
FIG. 7 is a sectional view of a radioactive solution transportation container using a radioactive substance-shielding member according to one embodiment of the present invention.

FIG. 7 indicates a radioactive solution transportation container 60 for storing a vial 63 containing a radioactive solution therein. A radioactive substance-shielding member of the transportation container 60 consists of a container part 61 and a lid part 62. The container part 61 is cylindrical, composed of a cup-like tungsten shielding body 65 having a recessed part 64 to accommodate the vial 63, and a cylindrical lead shielding body 66 surrounding a periphery 65*a* of the shielding body 65. The container part 61 is formed by setting the tungsten shielding body 65 in a mold and then injecting lead outside the tungsten shielding body 65. The lid part 62 is constructed of a disc-like tungsten shielding body 67 covering the tungsten shielding body 65 and a lead shielding body 68 covering an upper surface 67*a* and a peripheral surface 67*b* of the tungsten shielding body 67. A peripheral surface 66*a* of the lead shielding body 66, and bottom surfaces 65*b* and 66*b* of the tungsten shielding body 65 and lead shielding body 66 are coated with a plastic exterior container 69 in the container part 61. On the other hand, an upper surface 68*a* and a peripheral surface 68*b* of the lead shielding body 68 are coated with a plastic exterior container 70 in the lid part 62. The exterior containers 69 and 70 are coupled with each other when each of the engaging parts 69*a* and 70*a* of the containers 69 and 70 is engaged respectively, whereby the vial 63 is fixed and sealed in the recessed part 64.

The tungsten shielding bodies 65 and 67 are exchangeable in the above embodiment. Accordingly, the shielding member can be light in weight depending on the amount of radioactivity of the radioactive solution without changing the lead shielding bodies 66 and 68.

Figure 8:
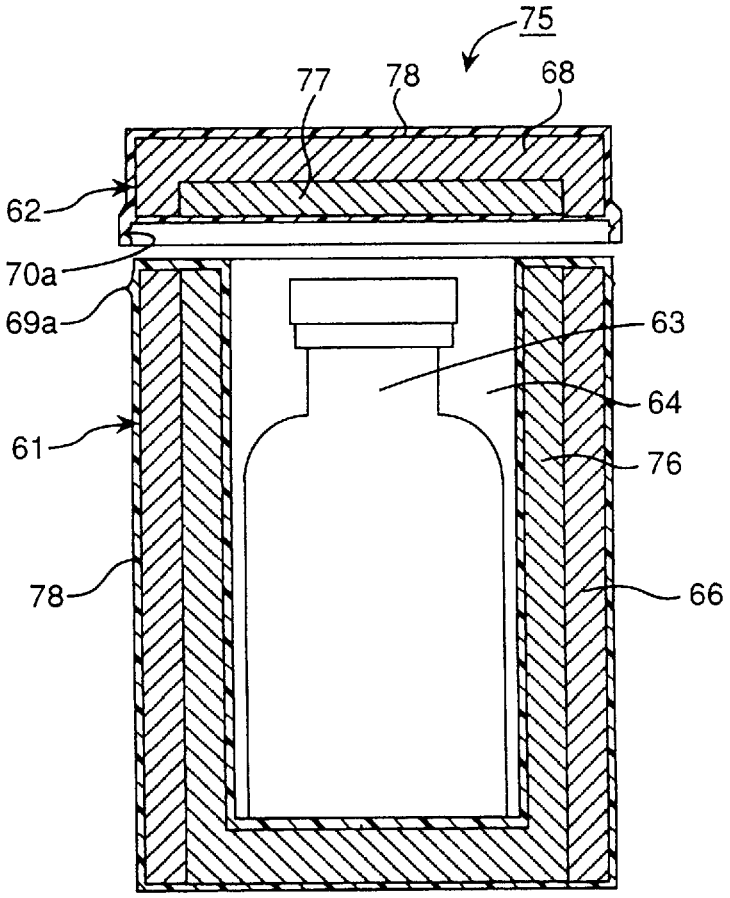
FIG. 8 is a sectional view of the radioactive solution transportation container of FIG. 7 according to a different embodiment of the present invention.

FIG. 8 represents a radioactive solution transportation container 75 of a different embodiment of the transportation container 60. The transportation container 75 uses shielding bodies 76 and 77 made of depleted uranium in place of the tungsten shielding bodies 65 and 67 of the transportation container 60. All the outer surfaces of the container part 61 and the lid part 62 are covered with a plastic exterior container 78. The other structural points of the transportation container 75 are the same as those of the transportation container 60 and thus the description thereof will be abbreviated here. Since every outer surface of the transportation container 75 is covered with the exterior container 78, the depleted uranium shielding bodies 76 and 77 cannot be exchanged.

The shielding member for radioactive substance according to the first aspect of the present invention constitutes the container part formed of the first shielding body and the second shielding body which has a higher shielding ability than the first shielding body. Moreover, a part of the recessed part accommodating radioactive substance is formed of the second shielding body. Therefore, the shielding member can be light in weight and compact in size while maintaining the same shielding ability as the conventional art. If the shielding member is of the same size as the shielding member in conventional art, the radiation shielding ability is enhanced, in other words, the intensity of radioactivity of radioactive substance stored in the recessed part may be increased.

The second shielding body is detachable from the first shielding body, so that the second shielding body may be exchanged with a shielding body of suitably selected thickness and material in accordance with the kind or amount of radioactivity of the radioactive substance stored in the recessed part. The radioactive substance-shielding member is fit for general purpose and economical.

The radioactive solution-producing apparatus according to a second aspect of the present invention utilizes the above radioactive substance-shielding member of the first aspect. Therefore, the apparatus is light-weight and compact while keeping the same shielding ability as the conventional one. Moreover, when the producing apparatus is constructed in the same size as the conventional one, the shielding ability against radioactive rays is increased, therefore allowing the radioactive intensity of the radioactive substance stored in the recessed part to be increased.

According to the manufacturing method for the radioactive substance-shielding member forming the third aspect of the present invention, the projecting part is coated with the coupling member in the axial direction thereof between the side shielding body and the bottom shielding body. Therefore, the shielding material is prevented from invading a gap formed between the projecting part and the side shielding body when the shielding material is injected into the mold, so that the radioactive substance-shielding member can be detached easily from the mold.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An apparatus for generating a radioactive solution using a radioactive substance shielding member, said radioactive substance shielding member comprising: a container part having a recessed part defining an opening for accommodating a radioactive substance; and a lid part fitted to the container part and covering the opening of the recessed part, wherein a bottom shielding body at a bottom part of the recessed part, a side shielding body defining a side part of the recessed part at a position orthogonal to an axial direction of the recessed part and extending approximately 60% of the total length from an upper part of the opening through the total length of the recessed part in the axial direction in the container part, and a shielding body disposed at a part facing the opening of the recessed part in the lid part are formed of tungsten, with other parts of the radioactive substance shielding member being formed of lead, the bottom shielding body and the shielding body facing the opening in the lid part having respective configurations determined in accordance with a radioactivity of the radioactive substance accommodated in the recessed part, and wherein the recessed part accommodates a column storing a parent radioactive nuclide and is provided with an eluant feed means connected to the column for feeding an eluant to the column and a radioactive solution discharge means connected to the column for discharging a radioactive solution including a daughter radioactive nuclide eluted from the column.

2. An apparatus for generating a radioactive solution according to claim 1, wherein, when the side shielding body extends a length not fully the total length of the recessed part in the axial direction, a coupling member extending in the axial direction of the recessed part thereby defining the side part of the recessed part is disposed to connect the side shielding body with the bottom shielding body.

3. A generating apparatus for radioactive solution according to claim 1, wherein the parent radioactive nuclide stored in the column is molybdenum-99.

4. A generating apparatus for radioactive solution according to claim 2, wherein the parent radioactive nuclide stored in the column is molybdenum-99.

5. A method for manufacturing a radioactive substance shielding member used with an apparatus for generating a radioactive solution, said radioactive substance shielding member comprising a container part having a recessed part defining an opening for accommodating a radioactive substance and a lid part fitted to the container part and covering the opening of the recessed part, the method comprising the steps of:

preparing a mold forming an outer shape of the container part; covering a side part of a projecting part to form the recessed part with a side shielding body formed of tungsten extending approximately 60% of the total length from a back end of the projecting part through the total length of the projecting part in the axial direction of the projecting part; covering a front end of the projecting part with a bottom shielding body formed of tungsten; and injecting lead into the mold.

6. A method for manufacturing a radioactive substance shielding member used with an apparatus for generating a radioactive solution according to claim 5, the method further comprising the steps of: after covering the side part of the projecting part and before covering the front end of the projecting part, covering a side face of the projecting part between the side shielding body and the bottom shielding body with a coupling member, having a melting temperature higher than the melting temperature of lead, formed along the axial direction of the projecting part.

* * * * *